US011183780B2

(12) United States Patent
Kaneko

(10) Patent No.: US 11,183,780 B2
(45) Date of Patent: Nov. 23, 2021

(54) CONNECTION STRUCTURE

(71) Applicant: FURUKAWA ELECTRIC CO., LTD., Tokyo (JP)

(72) Inventor: Hiroshi Kaneko, Tokyo (JP)

(73) Assignee: Furukawa Electric Co., Ltd., Tokyo (JP)

( * ) Notice: Subject to any disclaimer, the term of this patent is extended or adjusted under 35 U.S.C. 154(b) by 56 days.

(21) Appl. No.: 16/584,395

(22) Filed: Sep. 26, 2019

(65) Prior Publication Data

US 2020/0021044 A1 Jan. 16, 2020

Related U.S. Application Data

(63) Continuation of application No. PCT/JP2018/012427, filed on Mar. 27, 2018.

(30) Foreign Application Priority Data

Mar. 27, 2017 (JP) ..... JP2017-060325
Mar. 27, 2017 (JP) ..... JP2017-060326

(51) Int. Cl.
*H01R 4/62* (2006.01)
*H01R 4/18* (2006.01)
*H01R 11/12* (2006.01)

(52) U.S. Cl.
CPC ..... *H01R 4/62* (2013.01); *H01R 4/182* (2013.01); *H01R 11/12* (2013.01)

(58) Field of Classification Search
CPC ..... H01R 4/62; H01R 4/182; H01R 11/12; H01R 4/18; H01B 1/026; H01B 1/023
(Continued)

(56) References Cited

U.S. PATENT DOCUMENTS 6,364,969 B1 4/2002 Couper
9,252,505 B2 * 2/2016 Otsuka ..... H01R 13/03
(Continued)

FOREIGN PATENT DOCUMENTS

CN 1233294 A 10/1999
CN 1976126 A 6/2007
(Continued)

OTHER PUBLICATIONS

English translation of Decision to Grant a Patent in JP App. No. 2018-538789 dated Sep. 4, 2018.
(Continued)

*Primary Examiner* — Travis S Chambers
(74) *Attorney, Agent, or Firm* — Dorsey & Whitney LLP

(57) ABSTRACT

In a connection structure of the present disclosure, compression of a first connecting part of a first conductor forming a connecting component causes the first connecting part to be directly coupled to a second connecting part of a second conductor forming a body to be connected, to form an electrical connection structure, wherein the first conductor is made of copper or a copper alloy; and the second conductor has a Vickers hardness HV1 of 110 or more as measured at a position of the second connecting part in a state where the electrical connection structure is formed, and a Vickers hardness HV2 of 80% or more of the Vickers hardness HV1, the Vickers hardness HV2 being measured at a position of the second conductor which does not form the electrical connection structure.

10 Claims, 4 Drawing Sheets

(58) Field of Classification Search
USPC ..... 439/877
See application file for complete search history.

(56) References Cited

U.S. PATENT DOCUMENTS

| | | | | |
|---|---|---|---|---|
| 9,444,212 | B2 * | 9/2016 | Tachibana | H01R 43/02 |
| 2007/0128955 | A1 | 6/2007 | Nishio et al. | |
| 2008/0230269 | A1 | 9/2008 | Susai et al. | |
| 2009/0239411 | A1 | 9/2009 | Susai et al. | |
| 2011/0225820 | A1 | 9/2011 | Kondo et al. | |
| 2012/0305312 | A1 | 12/2012 | Mccullough et al. | |
| 2014/0224535 | A1 | 8/2014 | Otsuka et al. | |
| 2014/0273667 | A1 * | 9/2014 | Tachibana | B23K 26/32 439/877 |
| 2016/0099507 | A1 | 4/2016 | Tachibana et al. | |
| 2017/0141488 | A1 | 5/2017 | Seshimo et al. | |

FOREIGN PATENT DOCUMENTS

| | | | |
|---|---|---|---|
| CN | 101615727 | A | 12/2009 |
| CN | 101904061 | A | 12/2010 |
| CN | 102782943 | A | 11/2012 |
| CN | 103765680 | A | 4/2014 |
| CN | 103782449 | A | 5/2014 |
| EP | 1965464 | A1 | 9/2008 |
| JP | S5676268 | U | 6/1981 |
| JP | 2003249284 | A | 9/2003 |
| JP | 2007173215 | A | 7/2007 |
| JP | 2013004406 | A | 1/2013 |
| JP | 2013069613 | A | 4/2013 |
| JP | 2013080682 | A | 5/2013 |
| JP | 2013214439 | A | 10/2013 |
| JP | 2016045984 | A | 4/2016 |
| JP | 2016108617 | A | 6/2016 |
| JP | 2016167335 | A | 9/2016 |
| WO | 2015194640 | A1 | 12/2015 |

OTHER PUBLICATIONS

International Search Report and Written Opinion in PCT/JP2018/012427 dated Jun. 12, 2018 (Engl. translation of ISR only).
English translation of the International Preliminary Report on Patentability in PCT/JP2018/012427 dated Oct. 1, 2019.
English translation of the Written Opinion of the International Search Authority in PCT/JP2018/012427 dated Jun. 12, 2018.
English translation of a first Office Action in CN Application No. 201880021703.9 dated May 29, 2020.
Extended European Search Report for EP Application No. 18775219.1, dated Nov. 30, 2020.

* cited by examiner

CONNECTION STRUCTURE

CROSS REFERENCE TO RELATED APPLICATIONS

The present application is a continuation application of International Patent Application No. PCT/JP2018/012427 filed on Mar. 27, 2018, which claims the benefit of Japanese Patent Application No. 2017-060325 filed on Mar. 27, 2017 and Japanese Patent Application No. 2017-060326 filed on Mar. 27, 2017. The contents of these applications are incorporated herein by reference in their entirety.

BACKGROUND

Technical Field

The present disclosure relates to a connection structure which is lightweight, exhibits excellent connection reliability, and is less likely to cause necking breakage, wherein compression of a first connecting part of a first conductor forming a connecting component causes the first connecting part to be directly coupled to a second connecting part of a second conductor forming a body to be connected, and an electrical connection structure is formed by using a conductor made of an aluminum alloy as the second conductor, or as both the first and second conductors.

Background

In a connection structure formed by mutual coupling for electrically connecting a conductor of an electric wire or a cable (hereinafter, these may be collectively referred to as an "electric wire or the like") and a terminal, or conductors of electric wires or the like, usually, a copper-based material made of copper or a copper alloy is generally used as the conductor of an electric wire or the like or as both the conductor and the terminal. Recently, there has been contemplated use of an aluminum-based material made of aluminum or an aluminum alloy as the conductor in place of the copper-based material from the viewpoint of weight reduction or the like.

If the copper-based material of the conductor of an electric wire or the like is changed to the aluminum-based material, the weight reduction of the connection structure can be achieved, and surrounding incidental facilities can be simplified or the safety of work can be improved. Aluminum is a metal of which the amount of deposit is more than that of copper. The necessity of substituting the copper-based material of the conductor of an electric wire or the like by the aluminum-based material is considered to increase in the future.

Here, examples of an aspect of the connection structure include the following cases. In one case, by for example subjecting a terminal made of a copper-based material or a conductor connecting part of a sleeve to working deformation by pressure bonding or the like and compressing a conductor connecting part of an electric wire made of an aluminum-based material, or the like such that the outer periphery of the conductor connecting part of the electric wire or the like is wrapped, a conductor connecting part of a terminal or the like is coupled to the conductor connecting part of the electric wire or the like to form an electrical connection structure (for example, FIG. 1 or FIG. 2). In another case, a conductor connecting part of an electric wire or the like is coupled to other conductor connecting part by fastening and compressing the conductor connecting part of the electric wire or the like with a fastener such as a bolt or a screw, to form an electrical connection structure (for example, FIG. 3).

It can be considered that, in a point of contact as a portion in which a conductor connecting part of an electric wire or the like and a conductor connecting part of a terminal or the like contact each other, a large number of points formed by the contact of projections and recesses in micro-observation gather to form a (contact) surface. An aluminum-based material has lower strength than that of a copper-based material, and thus a problem is that: a connection structure formed by using an aluminum-based material for a conductor connecting part of an electric wire or the like has lower contact pressure of a point of contact (contact pressure) than that of a connection structure formed by using a copper-based material for a conductor connecting part of an electric wire or the like.

Furthermore, the temperature of each of these connection structures tends to be increased by heat generation involving energization, or the like. When a conductor connecting part of an electric wire or the like forming a connection structure is made of an aluminum-based material, and a conductor connecting part of a connecting component such as a terminal is made of a copper-based material, the temperature increase is apt to cause the deviation and release of a point of contact depending on a difference in coefficient of thermal expansion between the aluminum-based material and the copper-based material. That is, this is because the coefficient of linear expansion of copper is $17\times10^{-6}/°$ C., whereas the coefficient of linear expansion of aluminum is as high as $23\times10^{-6}/°$ C., and thus a temperature increase is apt to cause a void and the relative deviation of the position of the point of contact to occur in a joining (contact) interface between the conductor connecting part (aluminum-based material) of the electric wire or the like and the terminal or the like (copper-based material). The temperature increase causes the surface (projections and recesses) portion of the aluminum-based material which is at the position of the point of contact (the original position of the point of contact) when the connection structure is formed to relatively move and deviate from the position of the point of contact of the copper-based material, and thereby the surface (projections and recesses) portion of the aluminum-based material which is at the original position of the point of contact is exposed to air to be covered with an oxide film, and an oxide film which has high insulation properties and is present in a stable state is already present on the surface portion of the aluminum-based material which relatively deviates to be newly at the position of the point of contact. Therefore, the electrical resistance between the points of contact during energization increases, which causes the amount of heat occurring with Joule heat to increase, and a local temperature increase tends to occur. A problem is that this provokes further deviation of a point of contact to cause a further increased oxide film and increased electrical resistance in a vicious circle, which may cause a fire accident in the worst case.

Examples of means for solving such problems include a method for increasing the cross-sectional area of a conductor of an electric wire or the like, or reducing the amount of a current flowing in the conductor to prevent an increased difference in thermal expansion between a conductor connecting part (aluminum-based material) of an electric wire or the like and a terminal or the like (copper-based material) which form a connection structure, thereby inhibiting the temperature increase of the connection structure as much as possible.

However, the method causes the restriction of a space in which an electric wire and a cable are installed, or needs to increase the number of electric wires or cables to be installed. A problem of the method is that the method restricts a range of application of an environment, an application or the like in which the connection structure can be used, and lacks versatility.

It is considered that, as other means for solving the above problems, for example, not only a conductor of an electric wire or the like is made of an aluminum-based material but also a terminal is also made of an aluminum-based material. When the conductor of an electric wire or the like and the terminal are made of an aluminum-based material, a difference in thermal expansion between the materials forming the conductor of an electric wire or the like and the terminal is small. The deviation of the point of contact involving the small difference in thermal expansion is less likely to occur. However, since the contact pressure between the points of contact (contact pressure) is low, a problem is that: the deviation of the point of contact is apt to occur when the connection structure is used under an environment on which vibration and an external force frequently act, for example, and when the deviation of the point of contact occurs, a stable aluminum oxide film is formed on the deviating surface, which is apt to cause increased electrical resistance.

Meanwhile, a connection structure formed by using an aluminum-based material for both a conductor of an electric wire or the like and a terminal can have a weight much less than that of a conventional connection structure formed by using a copper-based material for both a conductor of an electric wire or the like and a terminal, and eliminates the problem of dissimilar metal corrosion or the like as compared with a connection structure formed by using an aluminum-based material for a conductor of an electric wire or the like, and formed by using a copper-based material for a terminal, and thus the development of the connection structure is expected.

As means for securing the oxidization inhibition of a conductor connecting part (aluminum-based material) of an electric wire and a conducting path with a conducting connecting part (copper-based material) of a terminal, or means for securing the oxidization inhibition of a conductor of an electric wire and a connecting part of a terminal (both the members are made of an aluminum-based material) and a conducting path between points of contact, a method is known, in which a compound such as a zinc powder or a silicon carbide powder is applied onto the surface of the conductor connecting part, to cause the compound to be interposed between the conductor connecting part (aluminum-based material) of the electric wire and the conducting connecting part (copper-based material) of the terminal.

However, since the method also has a low upper limit value of an allowable temperature range in which the compound can be used, the method cannot be used in an environment exceeding the allowable temperature range. In addition, the method requires work of uniformly applying the compound onto the surface of a conductor connecting part of an electric wire or the like during the assembly of a connection structure or work, and a problem is that this work requires time and cost.

Furthermore, as means for preventing the deviation of a point of contact, it is useful to employ a method for forming a serration including a plurality of grooves and projected parts on the surface (inner surface) of a conductor connecting part forming a connecting component, and firmly coupling the conductor connecting part forming the connecting part in which the serration is formed to a conductor connecting part of an electric wire by caulking and pressure bonding or the like (for example, Japanese Patent Application Publication No. 2003-249284 and International Publication No. WO 2015/194640).

However, the method for forming the serration in the conductor connecting part forming the connecting component complicates the structure of the connecting component to cause increased cost. In addition, it is necessary to cause a peak of the serration to bite into the conductor connecting part of the electric wire in order to increase connection strength. A problem is that: this causes necking breakage when a wire forming the conductor connecting part of the electric wire is thin, to cause a restricted range of application.

Other connection structure in which a connection conductor of an electric wire or the like made of an aluminum-based material is connected to a connection conductor of an electric wire or the like made of a copper-based material is proposed, for example, in Japanese Patent Application Publication No. 2016-167335. In the connection structure, a conductor of an electric wire or a cable made of an aluminum-based material is previously connected to a conductor of an electric wire or a cable made of a copper-based material before being laid in a construction site; the (coil) main body of the connected electric wire or the cable is made of an aluminum-based conductor; and only a terminal is made of a copper-based conductor.

However, in the connection structure described in Japanese Patent Application Publication No. 2016-167335, the length of the (coil) main body made of an aluminum-based conductor may be a length which can be always extended over a range (distance) used in a construction site or the like. When the change of the length is needed in the construction site, the length of the main body of the coil cannot be freely changed in the construction site or the like, and thus a problem is that the range (distance) or the like extended in the construction site or the like causes an insufficient or unnecessary length of the main body of the coil (aluminum-based conductor), and as a result, the handling of the material is poor, and sufficient weight reduction cannot be achieved.

Thus, in the prior art, in order to respond to the flow of an increase in a current or an increase in an operating environmental temperature in recent years, a connection structure which can be applied even in an application assuming a case where a high current is caused to flow in an electric wire or the like, or the electric wire or the like is used under a high-temperature environment, in particular, a connection structure which is lightweight, exhibits excellent connection reliability, and is less likely to cause necking breakage is not obtained. These applications have a risk of causing a fire accident when a copper-based material of a conductor of an electric wire or the like is substituted by an aluminum-based material, and thus the copper-based material is still continuously used as the conductor of an electric wire or the like under present circumstances. A case example is not found, in which a connection structure formed by using an aluminum-based material as a conductor of an electric wire or the like is applied to the applications.

Thus, the lightweight connection structure formed by using the aluminum-based material can be applied to high current applications and applications in which an operating environmental temperature increases, for example, applications such as a mega solar, fast charge of an electric vehicle, a wind power generation windmill and power conditioner, an electric power cable, a construction cable, an automotive wire harness, and a cab tire cable. Various advantages such as markedly improved handling of an electric wire or the like in a construction site or the like are expected, and thus the development of the connection structure is strongly desired.

SUMMARY

It is an object of the present disclosure to provide a connection structure which is lightweight, exhibits excellent connection reliability, and is less likely to cause necking breakage by using an aluminum alloy as a second conductor forming a body to be connected, and optimizing the mechanical characteristics of a portion which is compressed (compressed portion) and a portion which is not compressed (non-compressed portion) of the second conductor in a state where an electrical connection structure is formed.

It is another object of the present disclosure to provide a connection structure which is lightweight, exhibits excellent connection reliability, and is less likely to cause necking breakage by using an aluminum alloy for both a first conductor of a connecting component and a second conductor of a body to be connected, and optimizing the mechanical characteristics of a portion which is compressed (compressed portion) and a portion which is not compressed (non-compressed portion) of the second conductor in a state where an electrical connection structure is formed.

The present inventors considered as follows. An essential cause for deviation and release of a point of contact due to a difference in coefficient of thermal expansion between copper and aluminum is that the strength of an aluminum-based material is generally as low as half or less of that of a copper-based material, and the contact pressure of a point of contact (contact pressure) between copper and aluminum is small.

The present inventors considered as follows. An essential cause for deviation and release of a point of contact in a connection structure in which both a first connecting part of a first conductor and a second connecting part of a second conductor are made of an aluminum alloy is that the strength of an aluminum-based material is generally as low as half or less of that of a copper-based material, and contact pressure between points of contact (contact pressure) in the connection structure in which both the first connecting part and the second conductor are made of an aluminum alloy is smaller than that of a conventional connection structure in which both a first connecting part and a second connecting part are made of a copper-based material.

The present inventors found that low contact pressure is apt to cause the deviation and release of points of contact to occur when a force in a parallel direction or a force in a perpendicular direction, that is, a direction drawing away (releasing) the points of contact from each other acts on a surface forming the points of contact (contact surface). The deviation and release between the points of contact due to the small contact pressure are caused by not only the influence of the heat stress (thermal expansion difference between points of contact) involving the above-mentioned temperature increase but also the influence of stress (for example, an external force) from a surrounding environment, vibration occurring at an installation place, or the like. This makes it necessary to form points of contact which are less likely to be influenced by such external stress. Herein, the contact pressure is stress which perpendicularly acts on the surface of the point of contact.

The present inventors diligently studied in order to inhibit necking breakage while improving connection reliability on the premise that a connection structure is formed by using an aluminum-based material as a second conductor forming a body to be connected, or a connection structure is formed by using a conductor made of an aluminum alloy for both first and second conductors. The present inventors found that, by using an aluminum-based material having high strength (more strictly, hardness) as the second conductor forming the body to be connected, in detail, by increasing the Vickers hardness HV1 of a second connecting part in a state where an electrical connection structure is formed, and optimizing the Vickers hardness HV1 of the compressed portion (second connecting part) of the second conductor in the state where the electrical connection structure is formed such that the Vickers hardness HV1 is not excessively higher than the Vickers hardness HV2 of the non-compressed portion (the portion of the second conductor other than the second connecting part) of the second conductor which does not form the electrical connection structure (no hardness level difference occurs), a connection structure which is lightweight, exhibits excellent connection reliability, and is less likely to cause necking breakage can be provided, to complete the present disclosure.

That is, the summary of the present disclosure is as follows:

(1) A connection structure in which compression of a first connecting part of a first conductor forming a connecting component causes the first connecting part to be directly coupled to a second connecting part of a second conductor forming a body to be connected, to form an electrical connection structure, characterized in that: the first conductor is made of copper or a copper alloy; the second conductor is made of an aluminum alloy; and the second conductor has a Vickers hardness HV1 of 110 or more as measured at a position of the second connecting part in a state where the electrical connection structure is formed, and a Vickers hardness HV2 of 80% or more of the Vickers hardness HV1, the Vickers hardness HV2 being measured at a position of the second conductor which does not form the electrical connection structure.

(2) The connection structure according to above (1), wherein the second conductor has a Vickers hardness HV1 of 140 or more as measured at a position of the second connecting part in a state where the electrical connection structure is formed.

(3) The connection structure according to above (1) or (2), wherein the second conductor is made of a 6000 series aluminum alloy.

The summary of the present disclosure is continued as follows:

(4) A connection structure in which compression of a first connecting part of a first conductor forming a connecting component causes the first connecting part to be directly coupled to a second connecting part of a second conductor forming a body to be connected, to form an electrical connection structure, characterized in that: both the first and second conductors are made of an aluminum alloy; and the second conductor has a Vickers hardness HV1 of 110 or more as measured at a position of the second connecting part in a state where the electrical connection structure is formed, and a Vickers hardness HV2 of 80% or more of the Vickers hardness HV1, the Vickers hardness HV2 being measured at a position of the second conductor which does not form the electrical connection structure.

(5) The connection structure according to above (4), wherein the second conductor has a Vickers hardness HV1 of 140 or more as measured at a position of the second connecting part in a state where the electrical connection structure is formed.

(6) The connection structure according to above (4) or (5), wherein the second conductor is made of a 6000 series aluminum alloy.

According to the present disclosure, in a connection structure in which compression of a first connecting part of a first conductor forming a connecting component causes the first connecting part to be directly coupled to a second connecting part of a second conductor forming a body to be connected, to form an electrical connection structure, the first conductor is made of copper or a copper alloy; the second conductor is made of an aluminum alloy; and the second conductor has a Vickers hardness HV1 of 110 or more as measured at a position of the second connecting part in a state where the electrical connection structure is formed, and a Vickers hardness HV2 of 80% or more of the Vickers hardness HV1, the Vickers hardness HV2 being measured at a position of the second conductor which does not form the electrical connection structure. This can provide a connection structure which is lightweight, exhibits excellent connection reliability, and is less likely to cause necking breakage.

According to the present disclosure, in a connection structure in which compression of a first connecting part of a first conductor forming a connecting component causes the first connecting part to be directly coupled to a second connecting part of a second conductor forming a body to be connected, to form an electrical connection structure, both the first conductor and the second conductor are made of an aluminum alloy; and the second conductor has a Vickers hardness HV1 of 110 or more as measured at a position of the second connecting part in a state where the electrical connection structure is formed, and a Vickers hardness HV2 of 80% or more of the Vickers hardness HV1, the Vickers hardness HV2 being measured at a position of the second conductor which does not form the electrical connection structure. This can provide a connection structure which is lightweight, exhibits excellent connection reliability, and is less likely to cause necking breakage.

DETAILED DESCRIPTION

Hereinafter, an embodiment of a connection structure according to the present disclosure will be described in detail below.

Figure 1:
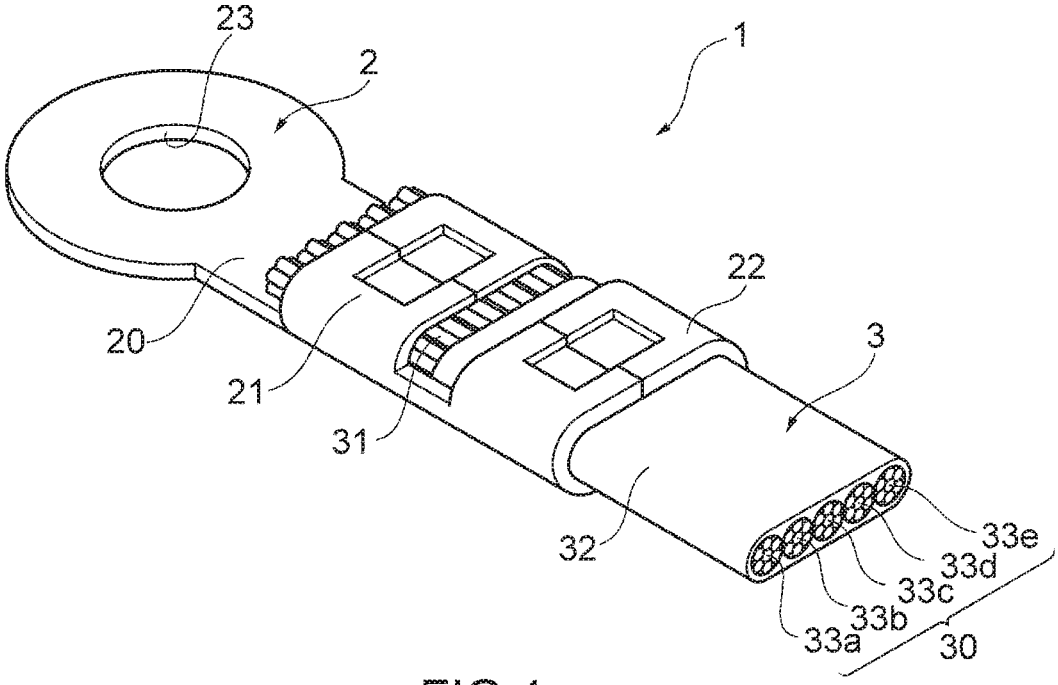
FIG. 1 is a schematic perspective view of a connection structure of a first embodiment according to the present disclosure.

FIG. 1 shows an example in a case where a connection structure of a first embodiment according to the present disclosure includes a covered electric wire as a body to be connected and a crimping terminal as a connecting component.

An illustrated connection structure 1 mainly includes a connecting component 2 and a body to be connected 3.

The connecting component 2 includes a first conductor 20, and a first connecting part 21 conductor-connected to the body to be connected 3 is provided on a part of the first conductor 20.

[Connecting Component]

Figure 2:
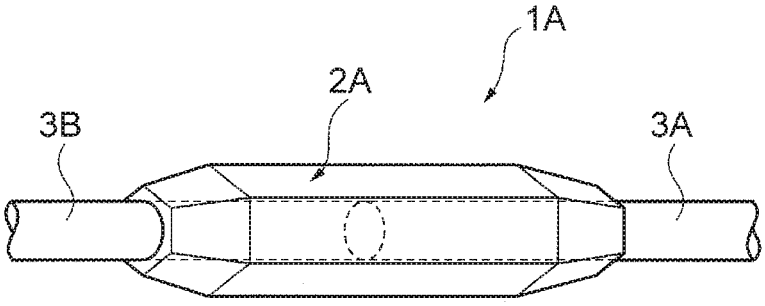
FIG. 2 is a schematic perspective view of a connection structure of a second embodiment according to the present disclosure.
Figure 3:
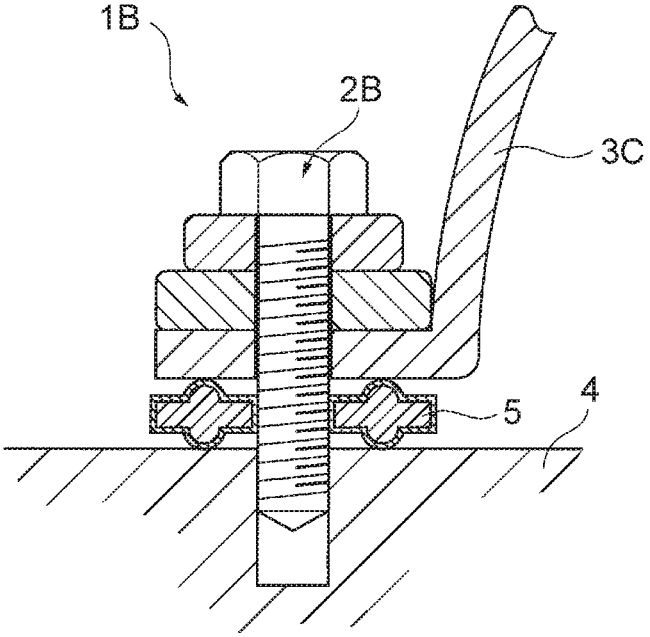
FIG. 3 is a schematic sectional view of a connection structure of a third embodiment according to the present disclosure.

The following case is shown in FIG. 1. The connecting component 2 is an open barrel type crimping terminal. The connecting component 2 includes the first connecting part 21 pressure-bonded to a second connecting part 31 of a second conductor 30 of the body to be connected 3 for conductor connection and formed as a wire barrel part, and an insulation barrel part 22 coupled by pressure bonding an insulating cover part 32 of the body to be connected 3 on one end side of the connecting component 2. The connecting component 2 has a circular (rounded) terminal hole 23 for conductive connection to another body to be connected (not shown) by using a fastener (not shown) such as a mounting screw on the other end (tip) side of the connecting component 2. As long as the connecting part 2 of the present disclosure includes the first connecting part 21 which can be conductively connected to the second connecting part 31 of the body to be connected 3 by compressing, the other portion of the connecting component 2 may have any configuration. In addition to the crimping terminal shown in FIG. 1, examples thereof include a connecting component 2A formed as a sleeve used in order to compress the circumference of the connecting part of electric wires or cables 3A and 3B for coupling, as shown in FIG. 2, and a connecting component 2B formed as for example a fastener such as a bolt or a screw tightening a body to be connected 3C for compressing, as shown in FIG. 3.

The first conductor 20 is made of copper or a copper alloy, for example. Examples of a copper-based material of copper or a copper alloy include, but are not particularly limited to, tough pitch copper, phosphorous-deoxidized copper, a brass-based alloy, a phosphor bronze-based alloy, a Cu—Sn—(Ni, Fe)—P-based alloy, a Cu—Ni—Si-based alloy, and a Cu—Cr-based alloy.

The first conductor 20 may be made of an aluminum alloy. It is preferable for the aluminum alloy to have a Vickers hardness equal to or greater than that of the second conductor 30 from the viewpoint of securing sufficient contact pressure between points of contact. For example, the high-strength aluminum alloy may have other composition in addition to a system having the same composition as that of the aluminum alloy forming the second conductor 30 without particular limitation. One example thereof is a 2000 series (Al—Cu-based), 5000 series (Al—Mg-based), 6000 series (Al—Mg—Si-based), or 7000 series (Al—Zn—Mg (—Cu)-based) aluminum alloy. The HV of the first conductor 20 is preferably 110 or more. The HV of the first conductor 20 is more preferably 125 or more, still more preferably 140 or more, and most preferably 155 or more. The excessively high HV of the first conductor 20 causes reduced moldability and stress corrosion cracking resistance, and thus it is preferable for the HV of the first conductor 20 to be 180 or less.

[Body to be Connected]

The body to be connected 3 includes the second conductor 30 made of an aluminum alloy. In FIG. 1, the following case is shown. The second conductor 30 is formed by setting five stranded wires 33*a* to 33*e* obtained by stranding seven wires in a parallel alignment state. The body to be connected 3 is a covered electric wire including the second conductor 30 including the five stranded wires 33*a* to 33*e*, and an insulating cover part 32 covering the outer circumference of the second conductor 30. The body to be connected 3 is not limited to only this case, and may be one covered electric wire, or a cable formed by covering a bundle of a plurality of covered electric wires with an insulating cover referred to as a sheath. The body to be connected 3 may be a naked electric wire which is not covered with an insulating cover.

[Feature Configuration of the Present Disclosure]

The main constitutional feature of the present disclosure is a configuration in which compression of a first connecting part 21 of a first conductor 20 forming a connecting component 2 causes the first connecting part 21 to be directly coupled to a second connecting part 31 of a second conductor 30 forming a body to be connected 3, to form an electrical connection structure, wherein the first conductor 20 is made of copper or a copper alloy, or made of an aluminum alloy; the second conductor 30 is made of an aluminum alloy; and the second conductor 30 has a Vickers hardness HV1 of 110 or more as measured at a position of the second connecting part 31 in a state where the electrical connection structure is formed, and a Vickers hardness HV2 of 80% or more of the Vickers hardness HV1, the Vickers hardness HV2 being measured at a position of the second conductor 30 which does not form the electrical connection structure. The adoption of the configuration makes it possible to provide a connection structure 1 which is lightweight, exhibits excellent connection reliability, and is less likely to cause necking breakage.

(i) Second Conductor Made of Aluminum Alloy

In the present disclosure, the second conductor 30 is made of an aluminum alloy. This can provide a lightweight connection structure. The aluminum alloy is not particularly limited, and the second conductor 30 is required to satisfy all of characteristics such as strength characteristics, a conductive property, molding and processability, and corrosion resistance. Furthermore, in the present disclosure, it is necessary to use an aluminum alloy having higher Vickers hardness than that of a conventional aluminum alloy as the second conductor 30. From this viewpoint, in the present disclosure, as the aluminum alloy suitably used for the second conductor 30, for example, it is preferable to use 5000 series (Al—Mg-based) and 6000 series (Al—Mg—Si-based) aluminum alloys. In particular, when the second conductor 30 is required to have a high electric conductivity, it is preferable to use a 6000 series (Al—Mg—Si-based) aluminum alloy. In order to reduce the heat stress of the connection structure 1, it is also effective to inhibit Joule heat generation during the energization of the second conductor 30. Therefore, the electric conductivity of the second conductor is preferably 40% IACS, more preferably 45% IACS or more, and still more preferably 50% IACS or more.

(ii) Second Conductor Having a Vickers Hardness HV1 of 110 or More as Measured at Position of Second Connecting Part 31 in a State where Electrical Connection Structure is Formed In the present disclosure, the second conductor 30 has a Vickers hardness HV1 of 110 or more as measured at the position of the second connecting part 31 made of an aluminum alloy in a state where the electrical connection structure is formed. This can provide a decrease in a hardness (strength) difference with the copper-based material forming the first connecting part 21 of the connecting component 2, or a hardness difference with the high-strength aluminum alloy used for the first connecting part 21 of the connecting component 2, to increase the contact pressure of a point of contact between the first connecting part 21 and the second connecting part 31 forming the electrical connection structure. As a result, the deviation and release of points of contact are less likely to occur even if heat stress (thermal expansion difference between points of contact) involving a temperature increase, stress (for example, an external force) from a surrounding environment, and external stress such as vibration occurring at an installation place act on the points of contact, and thus excellent connection reliability is obtained.

If the Vickers hardness HV1 measured at the position of the second connecting part 31 in a compressed state where the electrical connection structure is formed is less than 110, a hardness (strength) difference with the copper-based material forming the first connecting part 21 of the connecting component 2, or a hardness difference with the high-strength aluminum alloy used for the first connecting part 21 of the connecting component 2 is increased, to cause decreased contact pressure of the points of contact between the first connecting part 21 and the second connecting part 31 forming the electrical connection structure. As a result, excellent connection reliability is not obtained. For this reason, the Vickers hardness HV1 measured at the position of the second connecting part 31 in the compressed state is 110 or more, preferably 125 or more, more preferably 140 or more, still more preferably 155 or more, and most preferably 170 or more. In particular, when the connection structure is used in a high-temperature environment or a frequently vibrating environment, it is preferable that the Vickers hardness HV1 be 140 or more. The upper limit of the Vickers hardness HV1 is not particularly limited, and the Vickers hardness HV2 of the second conductor (wire rod) (in a non-compressed state) which allows drawing working without breaking is considered to have a limitation of at most about 240 considering the current production equipment, and thus it is preferable that the upper limit of the Vickers hardness HV1 (in a compressed state) be 300.

In a method for measuring the Vickers hardness HV1 at the position of the second connecting part 31 in the (compressed) state where the electrical connection structure is formed, for example, by exposing the cross section of the second connecting part 31 forming the electrical connection structure, and subjecting a cross section (transverse section) perpendicular to the longitudinal direction of the second connecting part 31 to mirror polishing, the Vickers hardness of the compressed second connecting part 31 in which the electrical connection structure is formed can be measured. As the value of the Vickers hardness HV1 is higher, better connection reliability is obtained. The method for exposing the cross section can be performed by cutting the electrical connection structure while maintaining the electrical connection structure by a band saw, a wire saw, a precision disk cutter, or the like, and causing an abrasive cloth or buffing to provide minimal projections and recesses of the cross section. The Vickers hardness is measured based on JIS Z 2244:2009. The Vickers hardness has a proportional relationship with tensile strength, and higher Vickers hardness means higher strength. For example, in the case of a 6000 series (Al—Mg—Si-based) aluminum alloy, the approximate value of tensile strength TS can be converted by substituting the measured value of the Vickers hardness for the formula (i) as shown below.

$$\text{Tensile strength TS (MPa)} = 3.70 \times \text{Vickers hardness HV} \quad \text{(i)}$$

Figure 4:
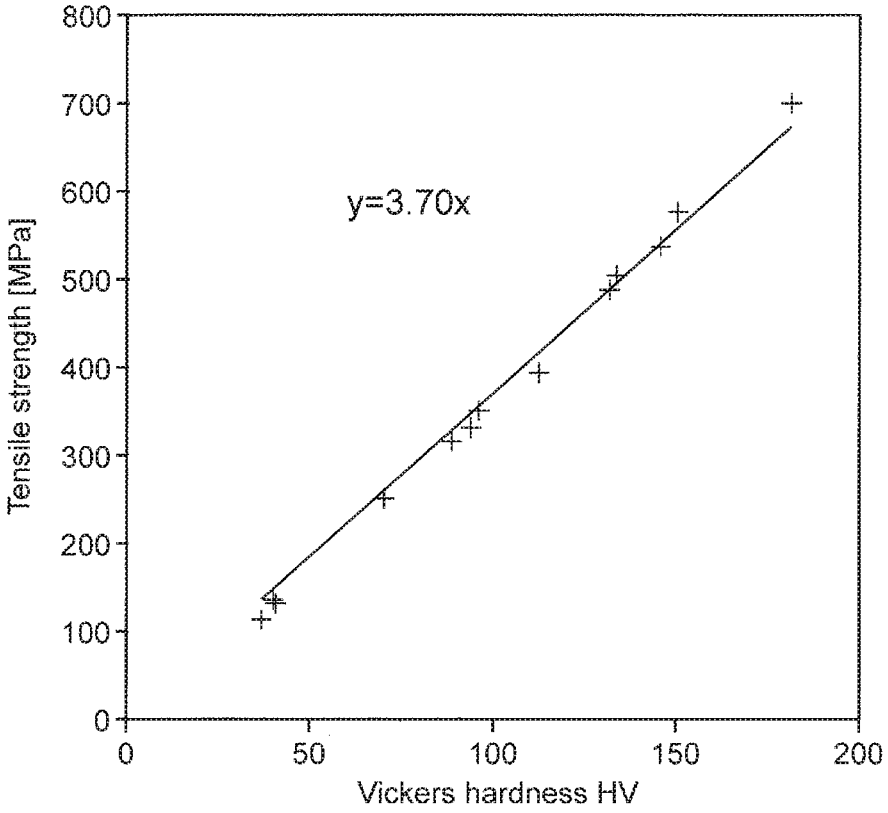
FIG. 4 is a view in which actual measured values of tensile strengths and Vickers hardnesses obtained by using various kinds of second conductors are plotted with the tensile strengths as a vertical axis and the Vickers hardnesses as a horizontal axis.

As shown in FIG. 4, 3.70 as a coefficient of the formula (i) is a value obtained by analyzing approximate straight lines for the actual measured values of the tensile strengths and the Vickers hardnesses of various 6000 series aluminum alloy wires according to the least-square method.

(iii) Vickers Hardness HV2 Measured at Position of Second Conductor 30 (in Non-Compressed State) which does not Form Electrical Connection Structure being 80% or More of Vickers Hardness HV1 Measured at Position of Second Connecting Part 31 in (Compressed) State where Electrical Connection Structure is Formed In the present disclosure, the Vickers hardness HV2 measured at the position (or portion) of the second conductor 30 in the (non-compressed) state where the electrical connection structure is not formed and the second conductor 30 is not compressed by the first connecting part 21 is 80% or more of the Vickers hardness HV1 measured at the position (or portion) of the second connecting part 31 in the (compressed) state where the electrical connection structure is formed and the second connecting part 31 is compressed by the first connecting part 21. This provides a small difference between the hardness (strength) of the second connecting part 31 which is in the compressed state, of the second conductor 30 and the hardness (strength) of the portion of the second conductor 30 which is not in the compressed state to cause no remarkable rigidity level difference. As a result, even if the second conductor 30 is pulled by a strong force, the whole second conductor 30 is likely to be uniformly extended, which is less likely to cause necking breakage to occur.

If the Vickers hardness HV2 measured at the position of the second conductor 30 in the non-compressed state is less than 80% of the Vickers hardness HV1 measured at the position of the second connecting part 31 in the compressed state, a difference between the hardness (strength) of the second connecting part 31 which is in the compressed state, of the second conductor 30 and the hardness (strength) of the portion of the second conductor which is not in the compressed state is increased, to cause a remarkable rigidity level difference. As a result, if the second conductor 30 is pulled by a strong force, local elongation (contraction) is apt to occur in the boundary portion of the second conductor 30 having a rigidity level difference, and necking breakage cannot be effectively inhibited. For this reason, the Vickers hardness HV2 measured at the position of the second conductor 30 (in the non-compressed state) in which the electrical connection structure is not formed is 80% or more of the Vickers hardness HV1 measured at the position of the second connecting part 31 in the (compressed) state where the electrical connection structure is formed, preferably 80% or more, more preferably 85% or more, still more preferably 90% or more, and most preferably 95% or more. The upper limit of a hardness ratio R (=(HV2/HV1)×100) is not particularly limited, and is a case where the Vickers hardness HV1 and the Vickers hardness HV2 are equal to each other, that is, 100%.

As means for increasing the Vickers hardness HV1 of the second connecting part 31 to 110 or more in the compressed state where the electrical connection structure is formed, for example, a method for using an aluminum alloy previously having high Vickers hardness HV1 as the second conductor 30, and a method for subjecting the second connecting part 31 to work hardening by compressing in connecting steps such as compressing, pressure bonding, and fastening steps are assumed. However, in the latter method, in the second conductor 30, a large hardness (strength) difference occurs between a compressed portion of the second connecting part 31 and a non-compressed solid conductor portion. As a result, it is considered that stress concentrates on a portion in which the strength difference (rigidity level difference) occurs in the second conductor, and necking (contraction) occurs in a portion on which the stress concentrates when external forces such as tension, bending, and twisting act on the second conductor 30, which is apt to cause breakage. For this reason, in order to increase the Vickers hardness HV1 of the second connecting part 31 to 110 or more in the compressed state where the electrical connection structure is formed, an increase in the hardness may be controlled in a range where the Vickers hardness HV2 is not less than 80% of the Vickers hardness HV1 even if an aluminum alloy previously having high Vickers hardness HV1 is used as the second conductor 30, and the second connecting part 31 is subjected to work hardening by compressing. The breakage involving necking is apt to occur when the wire diameter of the second conductor 30 is thinner. Therefore, the present disclosure particularly solves or provides a remarkable effect when applied to the second conductor having a thin wire diameter, which is preferable. For example, the wire diameter of the second conductor is preferably 1.5 mm or less, more preferably 1.0 mm or less, still more preferably 0.5 mm or less, and optimally 0.2 mm or less.

The aluminum alloy having a high Vickers hardness HV1 of 110 or more is not particularly limited, and as the aluminum alloy used for the second conductor 30, it is preferable to use, for example, a 6000 series (Al—Mg—Si-based) aluminum alloy in light of it being required to satisfy all of strength characteristics, a conductive property, molding and processability, corrosion resistance, or the like. When the second conductor 30 may have a comparatively low conductive property, a 5000 series (Al—Mg-based) aluminum alloy may be used.

Since a 6000 series (Al—Mg—Si-based) aluminum alloy manufactured by a conventional manufacturing method usually has small Vickers hardness, sufficient characteristics cannot be provided even if the 6000 series aluminum alloy is used as the second conductor of the present disclosure.

For this reason, in the present disclosure, it was found that a 6000 series (Al—Mg—Si-based) aluminum alloy having high Vickers hardness can be obtained, for example, by properly controlling alloy compositions such as Mg and Si, and manufacturing conditions. Therefore, it is preferable to use the above-mentioned specific 6000 series (Al—Mg—Si-based) aluminum alloy material having increased Vickers hardness as the second conductor 30 when the 6000 series aluminum alloy material is used as the second conductor.

Examples of a method for manufacturing an aluminum alloy having high Vickers hardness include a method for subjecting an Al—Mg—Si-based 6000 series aluminum alloy material to cold working at a degree of working $\eta$ of 4 or more without subjecting the material to an aging precipitation heat treatment. In particular, cold working at a large degree of working $\eta$ can cause the division of the metal crystal involving the deformation of the metallographic structure, and a crystal grain boundary can be introduced at a high density into the inside of the aluminum alloy material. As a result, the aluminum alloy material (grain boundary) is strengthened, and the Vickers hardness can be greatly increased. Such a degree of working $\eta$ is preferably 5 or more, more preferably 6 or more, and still more preferably 7 or more. When the degree of working $\eta$ exceeds 15, breakage occurs during drawing working. This tends to make it difficult to manufacture an electric wire (wire rod), and thus it is preferable to set the degree of working $\eta$ to 15 or less. Thermal refining annealing may be performed after cold working as necessary.

Furthermore, examples of suitable composition of the 6000 series aluminum alloy material include an aluminum alloy containing 0.2 to 1.8 mass % of Mg (magnesium), 0.2 to 1.8 mass % of Si (silicon), and 0.01 to 0.26 mass % of Fe (iron). From the viewpoint of reducing necking breakage, it is preferable to reduce the content of Fe.

The degree of working η is represented by the following formula (ii) when the cross-sectional area of the second conductor before cold working is taken as S1 and the cross-sectional area of the second conductor after cold working is taken as S2 (S1>S2):

$$\text{Degree of working } \eta \text{ (non-dimension)} = \ln(S1/S2) \quad \text{(ii)}$$

A working method may be appropriately selected according to the intended shape (a wire bar, a plate, a strip, a foil or the like) of the aluminum-based material, and examples thereof include a cassette roller die, groove roll rolling, round wire rolling, drawing working using a die or the like, and swaging. Various conditions (kind of lubricating oil, working speed, and working heat generation or the like) in the working as described above may be appropriately adjusted in a known range.

<Application of Connection Structure of the Present Disclosure>

The connection structure of the present disclosure is suitably applied to, in particular, large-current applications and applications causing a high operating environmental temperature, for example, applications such as a mega solar, fast charge of an electric vehicle, wind power generation windmill and power conditioners, an electric power cable, a construction cable, an automotive wire harness, and a cab tire cable.

Hereinbefore, embodiments of the present disclosure have been described. However, the present disclosure is not limited to the above embodiments, and includes all aspects included in the concept of the present disclosure and the appended claims, and various modifications can be made within the scope of the present disclosure.

EXAMPLES

Thereafter, Examples and Comparative Examples will be described to further clarify the effects of the present disclosure. However, the present disclosure is not limited to these Examples.

Examples 1 to 3 and Comparative Examples 1 to 4

Wires each having a diameter of 0.3 mm were manufactured by using bars or wire rods made of aluminum-based materials having compositions and diameter sizes as shown below according to manufacturing methods including drawing working as shown below. The seven manufactured wires were stranded to form a stranded wire as a second conductor.

Example 1

An Al-0.61 mass % Mg-0.58 mass % Si-0.26 mass % Fe alloy (component of A6201) having a diameter of 10 mm was subjected to cold drawing (degree of working η=7.01) such that the diameter was decreased to 0.3 mm.

Comparative Example 1

An Al-0.61 mass % Mg-0.58 mass % Si-0.26 mass % Fe alloy (component of A6201) having a diameter of 1.4 mm was annealed in a state where the alloy was held at 350° C. for 2 hours, and then subjected to cold drawing (degree of working η=3.09) such that the diameter was decreased to 0.3 mm.

Example 2

An Al-0.61 mass % Mg-0.58 mass % Si-0.26 mass % Fe alloy (component of A6201) having a diameter of 10 mm was subjected to cold drawing (degree of working η=7.01) such that the diameter was decreased to 0.3 mm, and then annealed in a state where the alloy was held at 200° C. for 10 seconds.

Comparative Example 2

An Al-0.61 mass % Mg-0.58 mass % Si-0.26 mass % Fe alloy (component of A6201) having a diameter of 1.4 mm was annealed in a state where the alloy was held at 350° C. for 2 hours, and then subjected to cold drawing (degree of working η=3.09) such that the diameter was decreased to 0.3 mm. Then, the alloy was subjected to a solution treatment in which the alloy was annealed in a state where the alloy was held at 540° C. for 15 seconds and an aging treatment (T6 treatment) at 180° C. for 5 hours.

Example 3

A wire containing Al-2.52 mass % Mg-0.11 mass % Si-0.25 mass % Fe-0.19 mass % Cr (component of A5052) and having a diameter of 6 mm was annealed in a state where the wire was held at 350° C. for 2 hours, and then subjected to cold drawing (degree of working η=5.99) such that the diameter was decreased to 0.3 mm.

Comparative Example 3

An EC-AL wire (electric aluminum wire of Al: 99.6 mass % or more) having a diameter of 10 mm was subjected to cold drawing (degree of working η=7.01) such that the diameter was set to 0.3 mm.

Comparative Example 4

An Al-0.11 mass % Mg-0.09 mass % Si-0.24 mass % Fe-0.21 mass % Cu alloy (component of A1120) having a diameter of 10 mm was subjected to cold drawing (degree of working η=7.01) such that the diameter was decreased to 0.3 mm.

Comparative Examples 5 and 6

Comparative Example 5

A 0.12 mass % Si-0.15 mass % Fe-2.3 mass % Cu-2.3 mass % Mg-6.1 mass % Zn-0.1 mass % Zr alloy (component of A7050) having a diameter of 10 mm was subjected to cold drawing. However, when the alloy was subjected to drawing until the diameter was decreased to about 7.8 mm, breaking of wire occurred frequently, and a wire rod could not be manufactured.

Comparative Example 6

A 1.1 mass % Si-0.7 mass % Fe-4.3 mass % Cu-0.8 mass % Mn-0.6 mass % Mg-0.2 mass % Zn alloy (component of A2014) having a diameter of 10 mm was subjected to cold drawing. However, when the alloy was subjected to drawing until the diameter was decreased to about 8.5 mm, breaking of wire occurred frequently, and a wire rod could not be manufactured.

[Evaluation Method]

A second connecting part of a second conductor produced as described above was pressure-bonded by a first connecting part of a copper crimping terminal as a connecting component, to form a connection structure, and the following characteristics were evaluated.

The relationship between the Vickers hardness of the second connecting part in the compressed state of the second conductor and contact pressure was investigated by the following method. First, Vickers hardness HV1 of the second connecting part in the compressed state of the second conductor was measured by using a microhardness tester HM-125 (manufactured by Akashi Corporation (manufactured by current Mitutoyo Corporation)) according to JIS Z 2244: 2009 after cutting an electrical connection structure with a precision disk cutter while maintaining the electrical connection structure, and subjecting the cross section (transverse section) of the electrical connection structure to mirror polishing which caused an abrasive cloth or buffing to provide minimal projections and recesses of the cross section. Vickers hardness HV2 at the position of the second conductor 30 which does not form the electrical connection structure was also measured from a cross section perpendicular to the longitudinal direction of the second conductor as with the Vickers hardness HV1. A method for exposing the cross section is also the same as that of the HV1. At this time, a test force was set to 0.1 kgf (0.98 N), and a holding time was set to 15 seconds. A percentage obtained by dividing the measured Vickers hardness HV2 (in a non-compressed state) by the Vickers hardness HV1 measured in the second connecting part in a compressed state was obtained as a hardness ratio R (%). It was difficult to actually measure the contact pressure of the second connecting part when forming the electrical connection structure, and thus the contact pressure was investigated by the simulation of the finite element method. LS-DYNA was used for the software of the simulation. Unloading analysis was performed after pressure bonding analysis. In the second connecting part of the second conductor compressed by a first connecting part of a connecting component, an area rate S (%) was obtained as a percentage of the area of the second connecting part contacting the first connecting part with contact pressure of 100 MPa or more in the whole area of the second connecting part contacting the first connecting part. When an annealed material of a general-purpose tough pitch copper wire was pressure-bonded with a terminal made of a copper alloy, the area rate S as the simulation result was 5%, and thus connection reliability in a case where the area rate S was 5% or more was evaluated as an acceptable level in the present Examples.

In order to indirectly measure contact pressure between the first conductor and the second conductor, a tensile strength test was performed based on "Crimping Terminal for Conductive Wires" JIS C 2805 (2010), to measure the stress (=PA). Stress similarly measured by using an annealed material of a general-purpose tough pitch copper wire for the second conductor was taken as PC, to calculate a stress ratio Q (=PA/PC). When the stress ratio Q was 1 or more, connection reliability was determined as an acceptable level.

Furthermore, the connection structure was formed by pressure bonding, and the second conductor was then pulled in a direction of 45 degrees with respect to the crimping terminal. At this time, whether necking breakage occurred was also investigated. A tensile force was 60 to 80% of the tensile strength of the second conductor to be used. As the tensile strength, a value obtained by multiplying the tensile strength of the second conductor to be used by the cross-sectional area of a non-compressed part of the second conductor was used. In addition, an electric conductivity was measured by a four-terminal method at room temperature in the state of a wire before forming the second conductor. These evaluation results are shown in Table 1. Regarding the occurrence or nonoccurrence of necking breakage as shown in Table 1, the nonoccurrence of breakage is shown as "○", and the occurrence of breakage is shown as "x".

TABLE 1

| | Vickers hardness HV of second conductor | | Area rate S of second connecting | | | | |
|---|---|---|---|---|---|---|---|
| | Measurement at position of second connecting part in compressed state (HV1) [—] | Measurement at position of second conductor (in non-compressed state) other than second connecting part (HV2) [—] | part contacting first connecting part with contact pressure of 100 MPa or more [%] | Stress ratio Q of tensile strength test [—] | Hardness ratio R (= HV2/HV1) [%] | Occurrence or nonoccurrence of necking breakage of second conductor | Electric conductivity EC [% IACS] |
| Example 1 | 160 | 152 | 10 | 2.15 | 95 | ○ | 50 |
| Comparative Example 1 | **100** | 85 | 3 | 0.78 | 85 | ○ | 54 |
| Example 2 | 130 | 117 | 7 | 1.62 | 90 | ○ | 54 |
| Comparative Example 2 | 115 | 81 | 8 | 1.03 | **70** | **x** | 50 |
| Example 3 | 145 | 131 | 9 | 1.81 | 90 | ○ | 35 |

TABLE 1-continued

| | Vickers hardness HV of second conductor | | Area rate S of second connecting | | | | |
|---|---|---|---|---|---|---|---|
| | Measurement at position of second connecting part in compressed state (HV1) [—] | Measurement at position of second conductor (in non-compressed state) other than second connecting part (HV2) [—] | part contacting first connecting part with contact pressure of 100 MPa or more [%] | Stress ratio Q of tensile strength test [—] | Hardness ratio R (= HV2/HV1) [%] | Occurrence or nonoccurrence of necking breakage of second conductor | Electric conductivity EC [% IACS] |
| Comparative Example 3 | **55** | 52 | 1 | 0.72 | 95 | ○ | 61 |
| Comparative Example 4 | **100** | 95 | 2 | 0.91 | 95 | ○ | 58 |

(Note)
Numerical values of underline bold letters in Table 1 are numerical values outside an appropriate range of the present invention.

From the results of Table 1, in all of Examples 1 to 3, the Vickers hardness HV1 of the second connecting part in a compressed state was 130 or more, and the area rate S was as large as 7% or more, and thus Examples 1 to 3 had excellent connection reliability. A hardness ratio R was 90% or more, and thus necking breakage also did not occur. The value of the stress ratio Q of the tensile strength test was also high, and high contact pressure occurred between the first conductor and the second conductor. In particular, both Examples 1 and 2 had a high electric conductivity EC of 50% IACS or more.

Meanwhile, in Comparative Example 1, the Vickers hardness HV1 of the second connecting part in a compressed state was as small as 100, and the numerical value of the area rate S was as small as 3%, and thus Comparative Example 1 had poor connection reliability. In Comparative Example 2, the Vickers hardness HV1 of the second connecting part in a compressed state was 115, which was 110 or more, and the numerical value of the area rate S was as large as 8%, and thus Comparative Example 2 had excellent connection reliability. However, the hardness ratio R was 70%, and thus necking breakage occurred. Furthermore, in Comparative Example 3, the Vickers hardness HV1 of the second connecting part in a compressed state was as small as 55, and the numerical value of the area rate S was as small as 1%, and thus Comparative Example 3 had poor connection reliability. Furthermore, in Comparative Example 4, the Vickers hardness HV1 of the second connecting part in a compressed state was as small as 100, and the area rate S was as small as 2%, and thus Comparative Example 4 had poor connection reliability. Both Comparative Examples 5 and 6 were structural aluminum alloys, and were 7000 series and 2000 series aluminum alloys known to have high strength. During drawing working for manufacturing the second conductor, breaking of wire occurred frequently, which made it impossible to manufacture the second conductor, and Comparative Examples 5 and 6 could not be evaluated as described above. In all of Comparative Examples 1, 3, and 4, the value of the stress ratio Q in the tensile strength test was low.

From the results, it was found that the second conductor has good connection reliability when the Vickers hardness HV1 of the second connecting part in the compressed state where the electrical connection structure is formed is 110 or more, and necking breakage can be prevented when the hardness ratio R is 80% or more; and a 6000 series aluminum alloy used as the second conductor is particularly subjected to drawing working at a degree of working of 4 or more to increase the strength, and all of characteristics including an electric conductivity are good.

Examples 4 to 7 and Comparative Examples 5 to 10

Wires each having a diameter of 0.3 mm were manufactured by using bars or wire rods made of aluminum-based materials having compositions and diameter sizes as shown below according to manufacturing methods including drawing working as shown below. The seven manufactured wires were stranded to form a stranded wire as a second conductor.

Example 4

An Al-0.61 mass % Mg-0.58 mass % Si-0.26 mass % Fe alloy (component of A6201) having a diameter of 10 mm was subjected to cold drawing (degree of working $\eta$=7.01) such that the diameter was decreased to 0.3 mm.

Example 5

An Al-0.61 mass % Mg-0.58 mass % Si-0.26 mass % Fe alloy (component of A6201) having a diameter of 10 mm was subjected to cold drawing (degree of working $\eta$=7.01) such that the diameter was decreased to 0.3 mm, and then annealed in a state where the alloy was held at 200° C. for 10 seconds.

Example 6

A wire containing Al-2.52 mass % Mg-0.11 mass % Si-0.25 mass % Fe-0.19 mass % Cr (component of A5052) and having a diameter of 6 mm was annealed in a state where the wire was held at 350° C. for 2 hours, and then subjected to cold drawing (degree of working $\eta$=5.99) such that the diameter was decreased to 0.3 mm.

Example 7

A wire containing Al-0.75 mass % Mg-0.53 mass % Si-0.26 mass % Fe-0.20 mass % Cu-0.11 mass % Cr (component of A6061) and having a diameter of 5 mm was subjected to cold drawing (degree of working η=5.63) such that the diameter was decreased to 0.3 mm.

Comparative Example 5

An Al-0.11 mass % Mg-0.09 mass % Si-0.24 mass % Fe-0.21 mass % Cu alloy (component of A1120) having a diameter of 10 mm was subjected to cold drawing (degree of working η=7.01) such that the diameter was decreased to 0.3 mm.

Comparative Example 6

An Al-0.61 mass % Mg-0.58 mass % Si-0.26 mass % Fe alloy (component of A6201) having a diameter of 1.4 mm was annealed in a state where the alloy was held at 350° C. for 2 hours, and then subjected to cold drawing (degree of working η=3.09) such that the diameter was decreased to 0.3 mm.

Comparative Example 7

An Al-0.61 mass % Mg-0.58 mass % Si-0.26 mass % Fe alloy (component of A6201) having a diameter of 1.4 mm was annealed in a state where the alloy was held at 350° C. for 2 hours, and then subjected to cold drawing (degree of working η=3.09) such that the diameter was decreased to 0.3 mm. Then, the alloy was subjected to a solution treatment in which the alloy was annealed in a state where the alloy was held at 540° C. for 15 seconds and an aging treatment (T6 treatment) at 180° C. for 5 hours.

Comparative Example 8

An EC-AL wire (electric aluminum wire of Al: 99.6 mass % or more) having a diameter of 10 mm was subjected to cold drawing (degree of working η=7.01) such that the diameter was decreased to 0.3 mm.

Comparative Examples 9 and 10

Comparative Example 9

A 0.12 mass % Si-0.15 mass % Fe-2.3 mass % Cu-2.3 mass % Mg-6.1 mass % Zn-0.1 mass % Zr alloy (component of A7050) having a diameter of 10 mm was subjected to cold drawing. However, when the alloy was subjected to drawing until the diameter was decreased to about 7.8 mm, breaking of wire occurred frequently, and a wire rod could not be manufactured.

Comparative Example 10

A 1.1 mass % Si-0.7 mass % Fe-4.3 mass % Cu-0.8 mass % Mn-0.6 mass % Mg-0.2 mass % Zn alloy (component of A2014) having a diameter of 10 mm was subjected to cold drawing. However, when the alloy was subjected to drawing until the diameter was decreased to about 8.5 mm, breaking of wire occurred frequently, and a wire rod could not be manufactured.

[Evaluation Method]

A second connecting part of a second conductor produced as described above was pressure-bonded by a first connecting part of a crimping terminal made of a 6000 series aluminum alloy as a connecting component to form a connection structure, and characteristics were evaluated. Methods for measuring values for evaluation were the same as those in Examples 1 to 3 and Comparative Examples 1 to 4. The evaluation results are shown in Table 2.

TABLE 2

| | Vickers hardness HV of second conductor | | Area rate S of second | | | | |
|---|---|---|---|---|---|---|---|
| | Measurement at position of second connecting part in compressed state (HV1) [—] | Measurement at position of second conductor (in non-compressed state) other than second connecting part (HV2) [—] | connecting part contacting first connecting part with contact pressure of 100 MPa or more [%] | Stress ratio Q of tensile strength test [—] | Hardness ratio R (= HV2/HV1) [%] | Occurrence or nonoccurrence of necking breakage of second conductor | Electric conductivity EC [% IACS] |
| Example 4 | 158 | 150 | 9 | 2.09 | 95 | ○ | 50 |
| Example 5 | 132 | 119 | 6 | 1.22 | 90 | ○ | 55 |
| Example 6 | 144 | 130 | 8 | 1.75 | 90 | ○ | 35 |
| Example 7 | 172 | 146 | 9 | 1.56 | 85 | ○ | 41 |
| Comparative Example 5 | **98** | 95 | 3 | 0.93 | 95 | ○ | 58 |
| Comparative Example 6 | **102** | 87 | 3 | 0.81 | 85 | ○ | 53 |
| Comparative Example 7 | 115 | 75 | 6 | 1.05 | **65** | **X** | 50 |
| Comparative Example 8 | **55** | 52 | 1 | 0.76 | 95 | ○ | 61 |

(Note)
Numerical values of underline bold letters in Table 2 are numerical values outside an appropriate range of the present invention.

From the results of Table 2, in all of Examples 4 to 7, the Vickers hardness HV1 of the second connecting part in a compressed state was 132 or more, and the area rate S was as large as 6% or more, and thus Examples 4 to 7 had excellent connection reliability. A hardness ratio R was 85% or more, and thus necking breakage also did not occur. The value of the stress ratio Q of the tensile strength test was also high, and high contact pressure occurred between the first conductor and the second conductor. In particular, both Examples 4 and 5 had a high electric conductivity EC of 50% IACS or more.

Meanwhile, in Comparative Example 5, the Vickers hardness HV1 of the second connecting part in a compressed state was as small as 98, and the area rate S was as small as 3%, and thus Comparative Example 5 had poor connection reliability. In Comparative Example 6, the Vickers hardness HV1 of the second connecting part in a compressed state was as small as 102, and the numerical value of the area rate S was as small as 3%, and thus Comparative Example 6 had poor connection reliability. Furthermore, in Comparative Example 7, the Vickers hardness HV1 of the second connecting part in a compressed state was 115, which was 110 or more, and the numerical value of the area rate S was as large as 6%, and thus Comparative example 7 had excellent connection reliability. However, a hardness ratio R was 65%, and thus necking breakage occurred. In addition, in Comparative Example 8, the Vickers hardness HV1 of the second connecting part in a compressed state was as small as 55, and the numerical value of the area rate S was as small as 1%, and thus Comparative Example 8 had poor connection reliability. Both Comparative Examples 9 and 10 were structural aluminum alloys, which were 7000 series and 2000 series aluminum alloys known to have high strength. During drawing working for manufacturing the second conductor, breaking of wire occurred frequently, which made it impossible to manufacture the second conductor. Both Comparative Examples 9 and 10 could not be evaluated as described above. In all of Comparative Examples 5, 6, and 8, the value of the stress ratio Q of the tensile strength test was low.

From the results, it was found that the second conductor has good connection reliability when the Vickers hardness HV1 of the second connecting part in the compressed state where the electrical connection structure is formed is 110 or more, and necking breakage can be prevented when the hardness ratio R is 80% or more; and a 6000 series aluminum alloy used as the second conductor is particularly subjected to drawing working at a degree of working of 4 or more to increase the strength, and all of characteristics including an electric conductivity are good.

In the present disclosure, a serration may be further provided in a (inner surface) portion forming a wire barrel part of the terminal as the connecting component. In this case, in order to cause the serration to bite into the hard second connecting part having a Vickers hardness HV1 of 110 or more in a good state, it is preferable to use a copper alloy having comparatively high strength such as Cu—Zn-based tombac or brass, Cu—Sn—P-based phosphor bronze, or Cu—Ni—Si-based Corson copper as the first conductor of the terminal. In the present disclosure, a compound as prior art may be further used together.

In the present disclosure, the second conductor may be configured to be covered with a metal selected from the group consisting of Cu, Ni, Ag, Sn, Pd, and Au. A state of an alloy or intermetallic compound containing the metal as a main constituent element is also included in the metal. Examples of a method for covering the second conductor include displacement plating, electrolysis plating, clad, and thermal spraying. In order to maximize a weight reduction effect, thinner covering is preferable, and thus displacement plating or electrolysis plating is preferable. A conductor having an intermediate wire diameter may be covered with the metal, followed by subjecting the conductor to drawing working. The second conductor is preferably covered with the metal in a range not causing increased processing cost and reduced recycling efficiency.

What is claimed is:

1. A connection structure in which compression of a first connecting part of a first conductor forming a connecting component causes the first connecting part to be directly coupled to a second connecting part of a second conductor forming a body to be connected, to form an electrical connection structure, characterized in that:

the first conductor is made of copper or a copper alloy;

the second conductor is made of an aluminum alloy; and the second conductor has a Vickers hardness HV1 of 110 or more as measured at a position of the second connecting part of the second conductor forming the body to be connected in a state where the electrical connection structure is formed, and a Vickers hardness HV2 of 80% or more of the Vickers hardness HV1, the Vickers hardness HV2 being measured at a position of the second conductor which does not form the electrical connection structure, wherein the connecting component is a terminal, and wherein the body to be connected is a stranded wire.

2. The connection structure according to claim 1, wherein the second conductor has a Vickers hardness HV1 of 140 or more as measured at a position of the second connecting part in a state where the electrical connection structure is formed.

3. The connection structure according to claim 1, wherein the second conductor is made of a 6000 series aluminum alloy.

4. A connection structure in which compression of a first connecting part of a first conductor forming a connecting component causes the first connecting part to be directly coupled to a second connecting part of a second conductor forming a body to be connected, to form an electrical connection structure, characterized in that:

both the first and second conductors are made of an aluminum alloy; and the second conductor has a Vickers hardness HV1 of 110 or more as measured at a position of the second connecting part of the second conductor forming the body to be connected in a state where the electrical connection structure is formed, and a Vickers hardness HV2 of 80% or more of the Vickers hardness HV1, the Vickers hardness HV2 being measured at a position of the second conductor which does not form the electrical connection structure, wherein the connecting component is a terminal, and wherein the body to be connected is a stranded wire.

5. The connection structure according to claim 4, wherein the second conductor has a Vickers hardness HV1 of 140 or more as measured at a position of the second connecting part in a state where the electrical connection structure is formed.

6. The connection structure according to claim 4, wherein the second conductor is made of a 6000 series aluminum alloy.

7. A connection structure in which compression of a first connecting part of a first conductor forming a connecting component causes the first connecting part to be directly coupled to a second connecting part of a second conductor forming a body to be connected, to form an electrical connection structure, characterized in that:

the first conductor is made of copper or a copper alloy;

the second conductor is made of an aluminum alloy; and the second conductor has a Vickers hardness HV1 of 110 or more as measured at a position of the second connecting part in a state where the electrical connection structure is formed, and a Vickers hardness HV2 of 80% or more of the Vickers hardness HV1, the Vickers hardness HV2 being measured at a position of the second conductor which does not form the electrical connection structure, wherein the Vickers hardness HV1 measured at the position of the second connecting part in a compressed state where the electrical connection structure is formed is 110 or more, and wherein the Vickers hardness HV2 measured at the position of the second conductor in the state where the electrical connection structure is not formed and the second conductor is not compressed by the first connecting part is 80% or more of the Vickers hardness HV1 measured at the position of the second connecting part in the state where the electrical connection structure is formed and the second connecting part is compressed by the first connecting part.

8. The connection structure according to claim 7, wherein the connecting component is an open barrel type crimping terminal, and the body to be connected is formed by setting a plurality of stranded wires in a parallel alignment state, and in the second connecting part of the second conductor compressed by the first connecting part of the connecting component, an area rate S (%) obtained as a percentage of the area of the second connecting part contacting the first connecting part with contact pressure of 100 MPa or more in the whole area of the second connecting part contacting the first connecting part is 5% or more.

9. A connection structure in which compression of a first connecting part of a first conductor forming a connecting component causes the first connecting part to be directly coupled to a second connecting part of a second conductor forming a body to be connected, to form an electrical connection structure, characterized in that:

both the first and second conductors are made of an aluminum alloy; and the second conductor has a Vickers hardness HV1 of 110 or more as measured at a position of the second connecting part in a state where the electrical connection structure is formed, and a Vickers hardness HV2 of 80% or more of the Vickers hardness HV1, the Vickers hardness HV2 being measured at a position of the second conductor which does not form the electrical connection structure, wherein the Vickers hardness HV1 measured at the position of the second connecting part in a compressed state where the electrical connection structure is formed is 110 or more, and wherein the Vickers hardness HV2 measured at the position of the second conductor in the state where the electrical connection structure is not formed and the second conductor is not compressed by the first connecting part is 80% or more of the Vickers hardness HV1 measured at the position of the second connecting part in the state where the electrical connection structure is formed and the second connecting part is compressed by the first connecting part.

10. The connection structure according to claim 9, wherein the connecting component is an open barrel type crimping terminal, and the body to be connected is formed by setting a plurality of stranded wires in a parallel alignment state, and in the second connecting part of the second conductor compressed by the first connecting part of the connecting component, an area rate S (%) obtained as a percentage of the area of the second connecting part contacting the first connecting part with contact pressure of 100 MPa or more in the whole area of the second connecting part contacting the first connecting part is 5% or more.

* * * * *